United States Patent [19]

Wilson

[11] 4,227,050

[45] Oct. 7, 1980

[54] VIRTUAL SOUND SOURCE SYSTEM

[76] Inventor: Bernard T. Wilson, 15847 SW. Springbrook Ct., Lake Oswego, Oreg. 97034

[21] Appl. No.: 2,541

[22] Filed: Jan. 11, 1979

[51] Int. Cl.[2] ..... H04R 5/02; H04R 1/02

[52] U.S. Cl. ..... 179/1 GA; 179/1 E; 181/144; 181/155

[58] Field of Search ..... 179/1 GA, 1 E; 181/144, 181/145, 152, 154, 155, 159, 191

[56] References Cited

U.S. PATENT DOCUMENTS

| | | | |
|---|---|---|---|
| 2,921,135 | 1/1960 | Hoodwin | 179/1 E |
| 3,326,321 | 6/1967 | Valuch | 181/144 |
| 3,582,553 | 6/1971 | Bose | 179/1 E |
| 3,727,004 | 4/1973 | Bose | 181/145 |
| 4,033,431 | 7/1977 | Ebejer | 181/191 |

FOREIGN PATENT DOCUMENTS

| | | | |
|---|---|---|---|
| 940474 | 5/1948 | France | 181/155 |
| 599404 | 10/1959 | Italy | 181/152 |
| 659818 | 10/1951 | United Kingdom | 179/1 E |

*Primary Examiner*—Douglas W. Olms
*Attorney, Agent, or Firm*—John T. Matlago

[57] ABSTRACT

A virtual sound source system comprises a pair of speaker cabinets of unique design positioned along the front wall of a listening room. The speaker cabinets together with the front wall, sidewalls and ceiling of the room provide for playing back recordings of conventional stereo sound and converting them into the equivalent of binaural recordings through headphones at the ears of the listener. Each of the speaker cabinets has a rearwardly facing low frequency range speaker disposed on the rear thereof and an upwardly facing high frequency range speaker disposed below a parabolic reflector which disperses sound forwardly thereof. The low frequency sounds are reflected with huge wavefronts off either side of the front wall, sidewalls and ceiling of the room so as to converge onto the listening area thereof. The high frequency sounds are dispersed by the parabolic reflectors onto the sidewalls and ceiling of the room from which they reflect so as to converge onto the listening area. By such an arrangement, paths of sound are physically created in the listening room that propagate toward the listening area in a manner very similar to and in context with those present in a concert hall during a live performance. Such paths of sound enable a listener standing anywhere in the listening area to sense direction, distance, size and shape from the reproduced sound as though from the original source and with the realism of a live performance. Thus, the listener perceives sound from a virtual, rather than a real, sound source.

15 Claims, 21 Drawing Figures

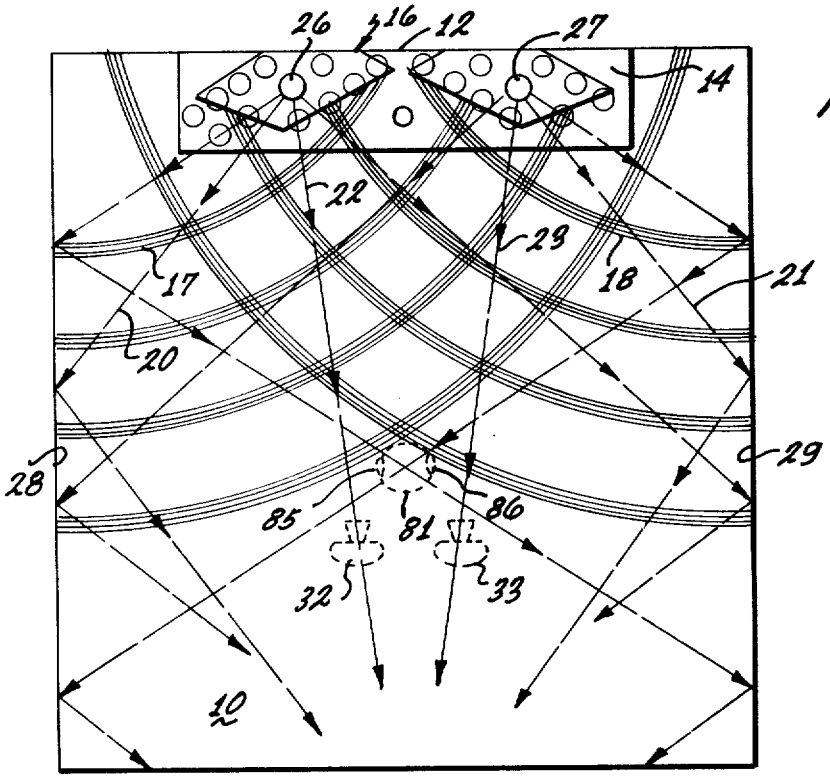
Fig. 1
PRIOR ART
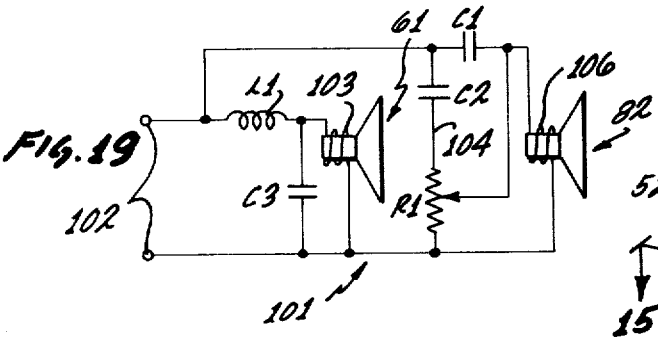
Fig. 19
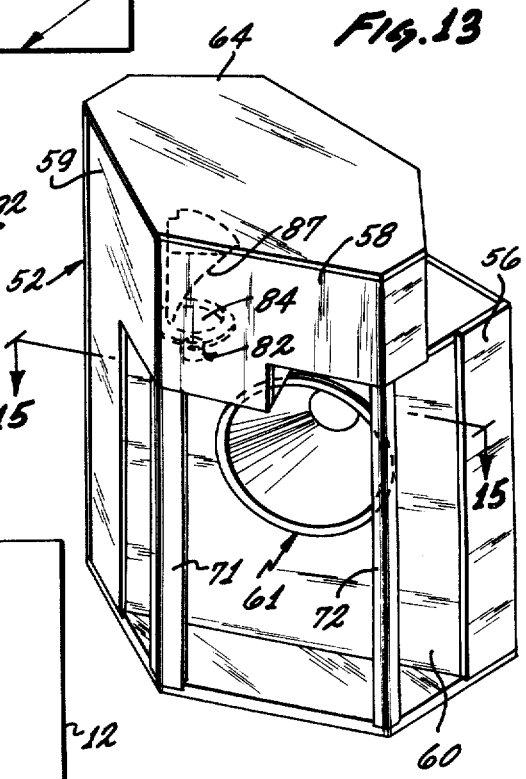
Fig. 13
Fig. 2
PRIOR ART
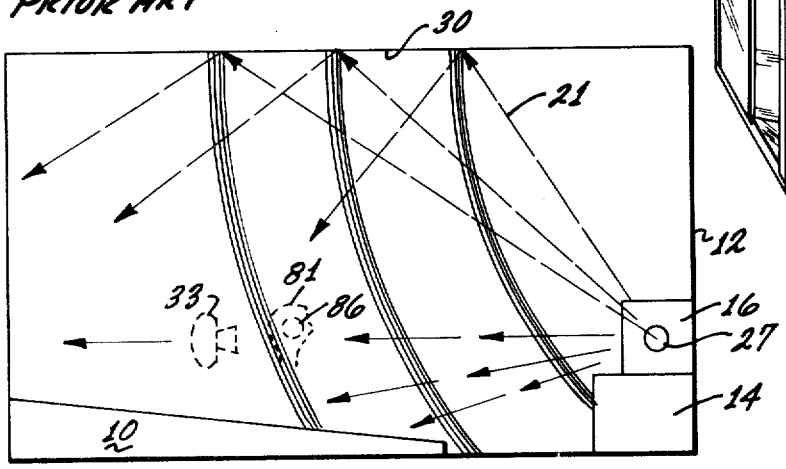

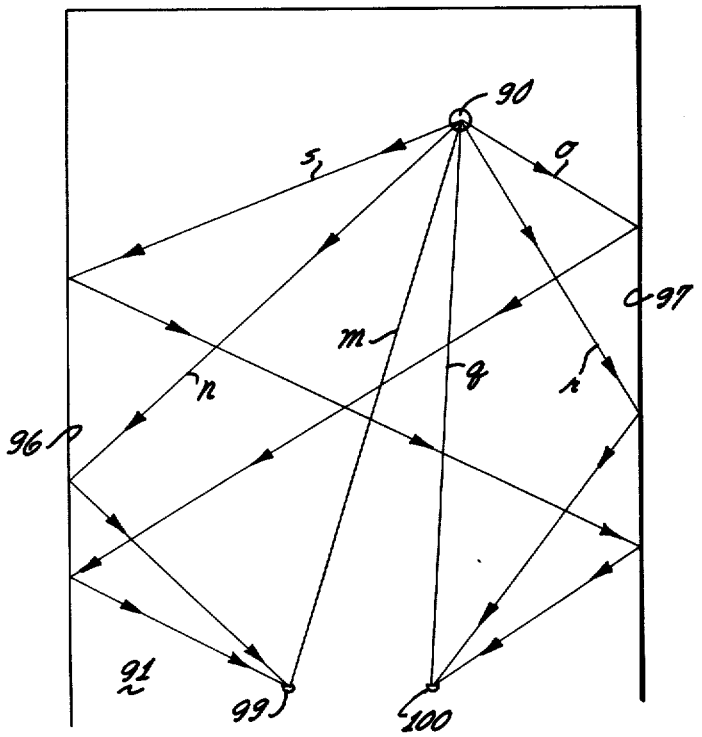
FIG. 9
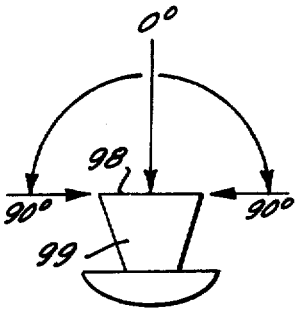
FIG. 10
FIG. 12
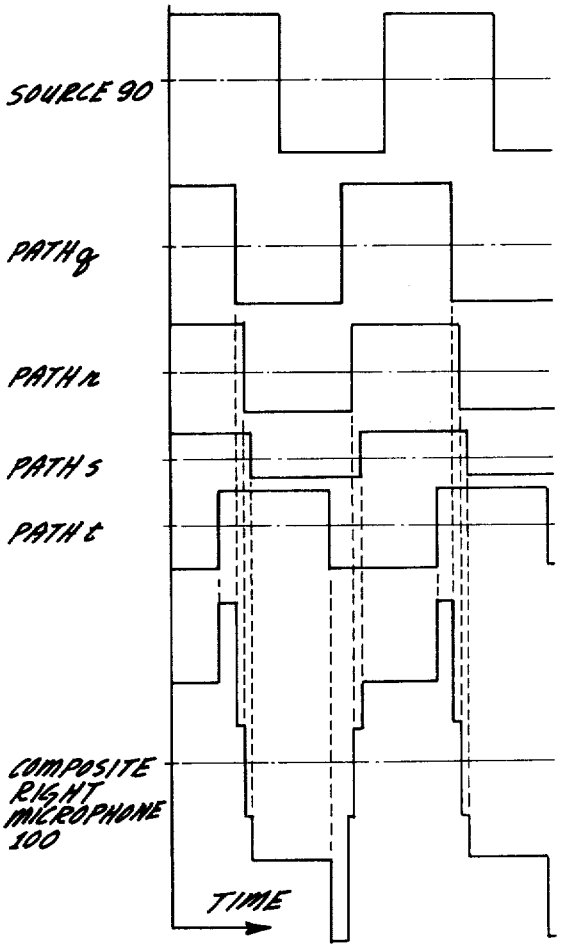
FIG. 11
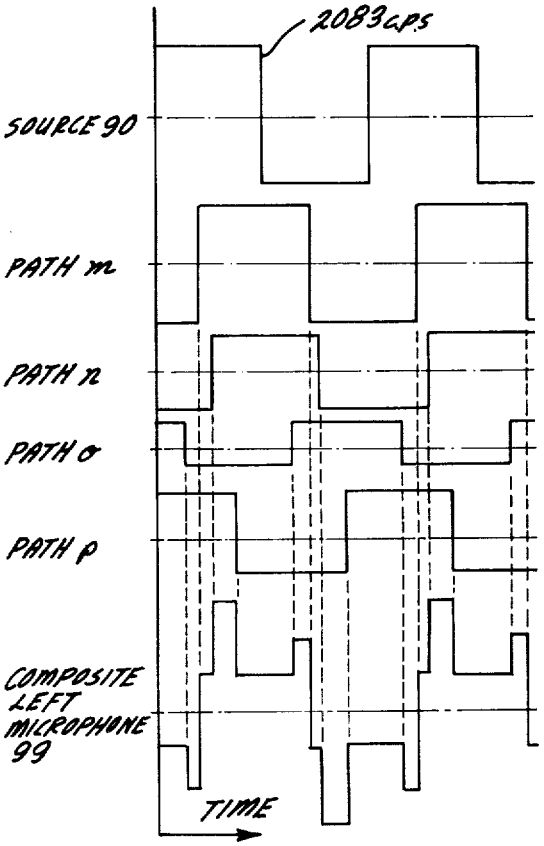

114°

VIRTUAL SOUND SOURCE SYSTEM

BACKGROUND OF THE INVENTION

This invention relates to virtual sound source systems and more particularly to improved speaker apparatus which provides for physically converting stereo signals reproduced from conventional stereo recordings into binaural signals at the ears of the listener.

There has been continual attempts to improve the realism of orchestral sounds reproduced from stereo recordings. This is because stereo, although described as providing three dimensional sound, actually lacks depth perception and spatial placement of the various instruments of the orchestra to the same degree sensed by a listener as the original performance.

A prior art system which provides a very realistic three dimensional reproduction of sound utilizes a binaural recording made by the use of microphones in the ears of a dummy head positioned in a concert hall several feet in front of an orchestra. When the binaural recording is played back and listened to by the use of headphones, the listener perceives an illusion of the live performance which is very realistic. In fact, the sound as provided by the binaural recording is so nearly perfect that it is often used as a standard by which other reproducing systems are measured as to their stereophonic effect. However, because of the need for headphones by the listener such systems have not proved to be very popular.

SUMMARY OF THE INVENTION

The speaker apparatus of the present invention comprises a pair of speaker cabinets each having on the top thereof a V shaped chamber with an outlet port. A reflector having a convex surface for dispersing sound is located in the corner of each of the V shaped chambers. A high frequency range speaker mounted just below the reflector in each of the chambers projects sound reproduced thereby upwardly for reflection off the convex surface of the reflector. A low frequency range speaker is mounted on an angularly disposed panel provided on the rear of each of the cabinets. The left and right speaker cabinets which are mirror images of each other are positioned with their low frequency range speakers facing rearwardly thereof slightly toward the respective front corners of the room and with the outlet ports of their V shaped chambers facing forwardly into the interior of the room.

The low frequency range of the two channels of sound reproduced from a conventional stereo recording radiate from the respective rearwardly facing low frequency speakers and reflect with a pronounced mushrooming effect off the front wall, side corners and ceiling of the room so as to converge with huge wavefronts onto the listening area thereof. The high frequency range of the two channels of sound reproduced from the conventional stereo recording radiate upwardly from the high frequency speakers to reflect off the convex surfaces of the respective reflectors and bounce between the walls of the V shaped chambers prior to being divergingly dispersed through the outlet ports thereof into the listening room. The V shaped chambers and their outlet ports are shaped so as to direct the dispersed sounds onto the sidewalls and ceiling of the listening room from which they reflect so as to converge onto the listening area thereof.

The outward dispersings of the sounds from each channel in this manner followed by their reflections so as to converge toward the listener physically recreate in the listening room propagation paths of the sounds toward the listener very similar to and in context with those present in the concert hall when the stereo recordings were made. The particular propagation paths of the sounds that first strike the ears of the listener are referred to as primary propagation paths. It is these paths of sound which preempt the listener's localization mechanism and provide the listener with information regarding the shape, size, distance and direction of the sound sources. Thus, it is the physical recreating of such primary propagation paths that enables the listener to perceive the live performance from the reproduced stereo recording with the realism provided by a binaural recording but without the need for headphones, and to do so from anywhere in the listening area of the room.

Accordingly, one of the objects of the present invention is to provide improved speaker apparatus for dispersing and reflecting sound reproduced from conventional stereo recordings so as to provide a three dimensional aural illusion of reality in a listening room.

Another object of the present invention is to provide a three dimensional reproduction of stereophonic sound which is equivalent to or better than that provided by a binaural recording but without the need for the listener to use headphones.

Another object of the present invention is to provide speaker apparatus for conventional stereo recordings which provides for duplicating in a listening room the primary propagation path characteristics of sound waves present at the microphones when the stereo recordings were made.

Another object of the present invention is to differently handle the manner in which the low and high frequency ranges of sound provided by a conventional stereo recording are dispersed and reflected in a listening room so that the reproduced sounds have propagation path characteristics similar to those the original sounds had at the microphones when the recordings were made.

Still another object of the present invention is to provide a pair of speaker cabinets for propagating conventional stereophonic sound wave signals in such a manner that a listener is able to hear the "stereo" effect from any location within a listening room.

Another object of the present invention is to physically recompose sound signals reproduced from stereo recordings so that the composition of the sound signals reaching the ears of a listener anywhere in a listening room is essentially the same as the composition of the sound that reaches the ears of a listener at a live performance.

A more specific object of the present invention is to provide a pair of speaker cabinets each including a low frequency stereo speaker facing away from the listener and reflecting off the front wall, sidewalls and ceiling of the listening room, and a high frequency stereo speaker facing upwardly and dispersing off a segment of a Y axis parabaloid so as to reflect off the sidewalls and ceiling of the listening room, whereby the sound field converging on the listening area of the room provides signal compositions at the ears of the listener like that provided by a binaural recording and earphones.

Other objects and attendant advantages will be appreciated by those skilled in the art as the invention becomes better understood by reference to the following description when considered in connection with the accompanying drawings.

BRIEF DESCRIPTION OF THE DRAWINGS

FIG. 1 is a diagrammatic plan view of a concert hall illustrating the manner in which sound waves of an orchestra are propagated therein;

FIG. 2 is a diagrammatic vertical side view of the concert hall of FIG. 1 illustrating the manner in which sound waves of the orchestra are propagated therein;

FIG. 9 is a diagrammatic plan view of the room of FIG. 5 illustrating the manner in which primary propagation paths of live sound emanating from the point source reach the left and right microphones when making a stereo recording;

FIG. 10 illustrates the angular range over which primary propagation paths of live sound emanating from a point source may approach each of the microphones when making a stereo recording;

FIG. 11 illustrates the individual and composite waveforms of the primary propagation paths of sound received by the left microphone in FIG. 9 from the point source;

FIG. 12 illustrates the individual and composite waveforms of the primary propagation paths of sound received by the right microphone in FIG. 9 from the point source;

FIG. 13 is a rear perspective view of the left speaker cabinet of the present invention;

FIG. 19 is a schematic diagram of the crossover and equalizer electrical circuit provided in each of the speaker cabinets of the present invention;

DESCRIPTION OF THE PREFERRED EMBODIMENT

Figure 3:
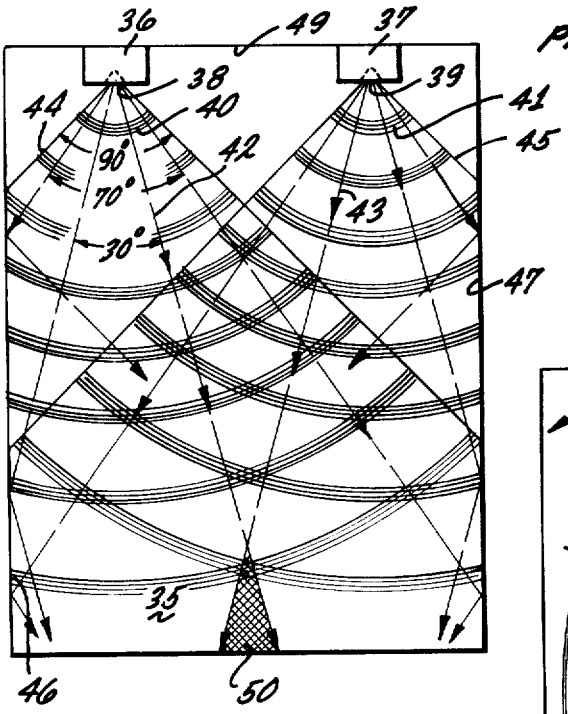
FIG. 3 PRIOR ART
FIG. 3 is a diagrammatic plan view of a listening room illustrating the manner in which sound waves reproduced from a stereo recording are propagated therein by use of a pair of conventional stereo loudspeakers.

Before describing the speaker system and apparatus of the present invention presentations will be made of the manner in which sound waves are propagated by an orchestra and by a conventional stereo system. Thus, reference will first be made to FIGS. 1 and 2 of the drawings which diagrammatically illustrate plan and vertical views, respectively, of a large rectangularly shaped concert hall 10 having a front wall 12 which may typically be a hundred and fifty feet in length. Extending along the front wall 12 of the concert hall 10 is a stage 14 having the various instruments of a symphony orchestra 16, for example, placed about thereon. Each instrument represents a point of source of sound, such as point sources 26 and 27 on the left and right sides of the platform 14. The orchestra 16 thus provides an overall, spread out, complex source of sound.

The lowest frequency sounds of the orchestra are represented by the successive series of curved lines 17 and 18, and tend to radiate as though from a large, omni-directional source, with a pronounced mushrooming effect whenever a reflecting surface is encountered. Thus, the combined results of reflections and mushrooming from the front wall 12, the side walls 28 and 29, the ceiling 30 and some direct radiation are huge wavefronts directed at a slight angle downward from the ceiling toward the listener, and converging toward him from the left and right.

As the frequencies of the sound increase, the mushrooming effect becomes less and less pronounced, so that propagation toward the listener becomes more and more a specific function of reflections, with negligible effect caused by mushrooming at the highest sound frequencies.

At about 350 Hz, the mushrooming effect has reduced to the point of being a minor consideration, so that the propagation of sound toward the listener above this frequency is more accurately represented by the vectors such as 20, 21, 22, 23 and others shown radiating into the listening area from individual sources such as sources 26 and 27 on the respective left and right sides of the stage 14. These high frequency sound waves are characteristically much more directional and sensitive to reflective surfaces in their paths than the low frequency sound waves. Although a small portion of these higher frequency sound waves as represented by 22 and 23 radiate directly onto the listening area, a substantial portion of them as represented by 20 and 21 advance so as to reflect from the left and right side walls 28 and 29 and the ceiling 30 and thereby radiate into the listening area. It should be noted that the higher frequency sound waves which radiate downwardly from the points on the right and left sides of the stage 14 are absorbed by the clothing of the audience and the carpet on the floor of the concert hall.

It should be appreciated of course, although not illustrated, that sound similarly simultaneously radiates from each of the other sources or points indicated on the left and right sides of the stage 14.

It should now be clear that because of their individual characteristics, the range of sound waves above about 350 Hz. are effectively propagated into the concert hall in a different manner than the range of the sound waves below about 350 Hz.

As illustrated in FIGS. 1 and 2, when it is desired to reproduce the performance of the orchestra 16 as played in the concert hall 10, a pair of spaced microphones 32 and 33 are placed in the listening area in front of and preferably centrally of the orchestra 16. These microphones 32 and 33 are used for picking up the sound so that it can be recorded to provide two stereo channels in a conventional manner.

Figure 4:
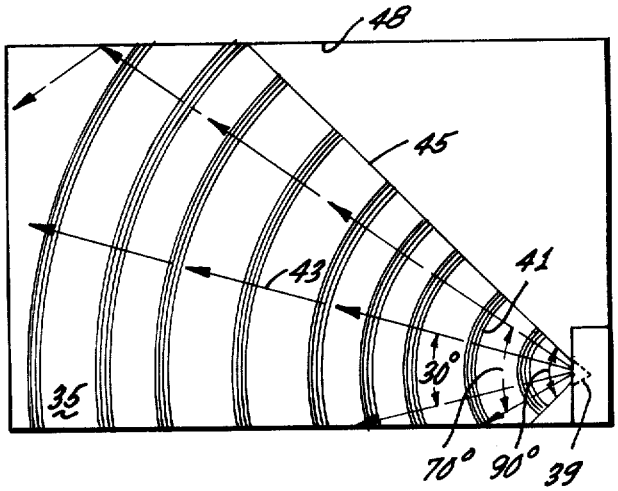
FIG. 4 PRIOR ART
FIG. 4 is a diagrammatic vertical side view of the listening room of FIG. 3 illustrating the manner in which sound waves reproduced from a stereo recording are propagated therein by use of conventional stereo loudspeakers.

Referring next to FIGS. 3 and 4, diagrammatic illustrations of plan and vertical views are shown of how the two stereo channels of sound picked up and recorded by use of the pair of microphones 32 and 33 are played back in a rectangular living room 35 which is typically smaller than the concert hall 10. The sound of the orchestra 16 is reproduced in room 35 by use of a conventional stereo system which includes two spaced speaker cabinets 36 and 37 located along the front wall 49 thereof. The speaker cabinets 36 and 37 respectively have conventional cone-type loudspeakers 38 and 39 mounted on the front thereof facing the listening area. Each of the loudspeakers 38 and 39 radiates a full range of sound into the room 35. Similarly to FIGS. 1 and 2, the low frequency sound waves that radiate from the loudspeakers 38 and 39 are respectively represented by successive series of curved lines 40 and 41 and the directional higher frequency sound waves that radiate therefrom are respectively represented by vectors 42, 44 and 43, 45.

The low frequency sound waves 40 and 41 advance into the room 35 with small wavefronts because they originate from small circular openings of the loudspeakers 38 and 39, each covering a span of about 90 degrees and becoming larger as they progress into the room. As the frequencies increase, the angular span covered by the sound waves as they advance from the loudspeakers 38 and 39 into the listening room decreases, becoming about 70 degrees in the midrange of sound, and only 30 degrees in the high frequency range.

From this, as illustrated in FIGS. 1, 2, 3 and 4, it is apparent that the primary propagation paths advancing toward the listener from a conventional stereo loudspeaker system are not at all like the primary propagation paths advancing toward the listener from an orchestra. Further, the primary propagation paths from the conventional speakers are characteristic of direct radiating loudspeakers, thus identifying them as to size, shape and location by sounds emanating from them. It is for this reason that the listener is always aware that he is listening to loudspeakers as the source of sound when listening to a conventional stereo system. Substantially all the directional characteristics of the reproduced sounds as sensed by the listener are obtained from the relative phase and amplitudes obtained from the tw channels of stereo recording. Thus, the locations, i.e., the placements or localizations of the sounds of the various instruments in the orchestra 16 appear to the listener to be generally coming at best from the points between the two loudspeakers 38 and 39, which of course is inconsistent with the actual location of these instruments on the stage 14 which may be spread over a 100 foot span, for example. It should now be clearly understood that with conventional stereo systems the various instruments of the orchestra do not sound like they are spread over a large area as they are in a live concert hall.

It should be further noted that with conventional stereo there is typically only a small area 50 near the back of the listening room 35, as illustrated in FIG. 3, where the listener can stand and be certain of receiving a full frequency range of the stereo effect. This is because of the highly directional aspects of the higher frequency sound waves, such as the sound waves 42 and 43, which tend to diverge at such a small angle upon radiating from the small sources provided by the stereo loudspeakers 38 and 39 that they do not intermix until they reach the back of the room.

In order to further understand the problems associated with the propagation of sounds by a conventional stereo system, a comparison will next be made of the composition of the live sound received by a listener's ears as compared with the composition of the live sound recorded by a pair of microphones when making a stereo recording. Accordingly, reference will next be made to FIG. 5 which illustrates the primary propagation paths of sound that emanate from a point source 90 located near the front of a small concert hall 91 and received by the left and right ears 93 and 94 of a listener 92 located in the middle of the hall 91 and facing the front thereof.

The primary propagation paths of sound are by definition a particular set, of all the propagation paths of sound actually present in the concert hall, which strike the ears 93 and 94 of the listener 92 on the first pass of the sound waves from the source 90 toward the rear of the hall. The primary propagation paths are thus selected and are the only ones of the literally infinite number of propagation paths actually present in the hall 91 that will strike the listener's ears at a particular orientation of the head. As previously mentioned, it has been determined that it is from these primary propagation paths that the listener discerns the direction, distance, size and shape of the sound source.

Figure 5:
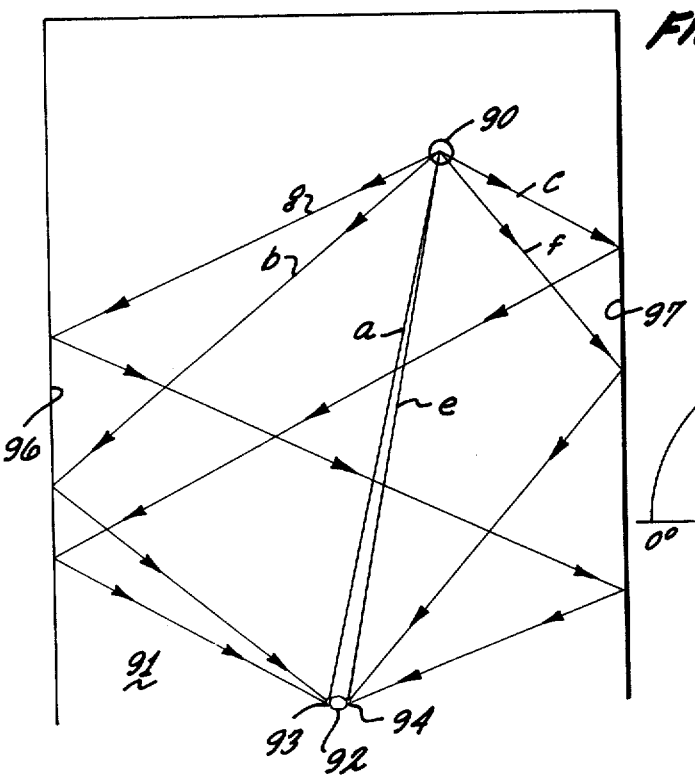
FIG. 5 is a diagrammatic plan view of a room illustrating the manner in which primary propagation paths of live sound emanating from a point source reach the left and right ears of a listener facing the front of the room.

As illustrated in FIG. 5, the primary propagation paths of sound in the concert hall 91 to each of the ears 93 and 94 include a direct path and reflected paths off the side walls and ceiling of the concert hall 91. In the case of each reflected path the angle of incidence is equal to the angle of reflection. Thus the primary propagation paths of sound in the concert hall toward the left ear 93 include a direct path a , a first reflected path b reflecting once off the left wall 96, a second reflected path c reflecting first off the right wall 97 and then off the left wall 96, and a third reflected path d (not shown) reflecting down off the ceiling of the concert hall.

In a similar manner, the primary propagation paths of sound in the concert hall 91 toward the right ear 94 include a direct path e, a first reflected path f reflecting once off the right wall 97, a second reflecting path g reflecting first off the left wall 96 and then off the right wall 97, and a third reflecting path h (not shown) reflecting down off the ceiling of the concert hall 91.

Next to be described is the amplitude and timing of the sound signals that arrive at the ear along each of these paths. In order to provide a simplified and meaningful presentation, it will be assumed that the sound emanating from the point source 90 is a continuous square wave having a frequency of 2083 cycles per second and having a predetermined amplitude.

First to be pointed out is that the amplitude of the square wave signal from source 90 is attenuated as it moves along the respective paths. For example, the distance attenuation loss of the sound signal may be 50% of its initial amplitude in a distance of 100 feet. Thus, using this basis, the distance attenuation loss of the sound signal that reaches the ears 93 and 94 by each of the paths a–h indicated in FIG. 5 is considered to be a direct function of its length.

Figure 6:
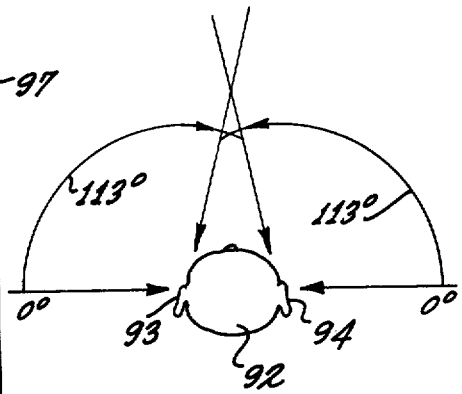
FIG. 6 illustrates the angular range over which primary propagation paths of live sound emanating from a point source may approach the left and right ears of the listener in FIG. 5.

Next to be pointed out is that the amplitude of the square wave sound signal that reaches each of the ears 93 and 94 by each of these paths is further attenuated by the projected horizontal angle at which each path approaches the ear. Thus, as illustrated in FIG. 6, with the listener facing the front of the concert hall 91, a sound signal approaching the ear 93, for example, along a path normal to the left side of the head of the listener is assumed to have a zero amplitude loss. However, as the direction of the path of the signal approaching the left ear 93 moves toward the front of the listener, the angle loss in amplitude will increase approximately linearly up to about 113 degrees, at which time the sound wave signal will miss the ear 93 completely. Due to the physical configuration of the human ear, the vertical angle at which a sound path enters the ear has very little attenuative affect from about 20 degrees below horizontal to about 90 degrees above horizontal. Thus the angular attenuation of paths reflected from the ceiling is due almost entirely to the projected horizontal angle of such paths toward the listener's ears. It should now be understood that the sound signal approaching each of the ears has a zero angle loss in amplitude at a projected horizontal angle of 0 degrees and a loss of substantially 100% at about 113 degrees for which approach the sound signal completely misses the ear.

It should now be understood that to arrive at the amplitude of the sound signal that strikes the listener's ears along each of the paths in FIG. 5, it is necessary to take two things into consideration. First, the attenuation loss due to distance by whichever path the sound signal takes, which loss is subtracted from the original sound signal amplitude, and then the attenuation loss due to angle by whatever path the signal takes which loss is further subtracted from the original sound signal amplitude.

Now there is another factor to consider to determine the compositions of the sound signals that reach the ears and that is the relative position of each of the square wave signals along each of the primary propagation paths when they arrive at the respective ears 93 and 94. Since the length of each of the paths can be determined and the speed of the sound signal is known, it it possible to calculate the time it takes for the sound signal to reach the ear by each of the paths. Dividing this time by the period of a cycle of a 2083 square wave determines the number of whole cycles and fraction of a cycle that this time represents. Then, by taking the fraction of the cycle, it is possible to illustrate the square wave signals in FIG. 7 for each of the paths a, b, c, and d according to their amplitudes and on a relative time basis as to when they strike the ear 93. All the square wave signals in FIG. 7 are then summed up to obtain the composite of the sound signal that strikes the left ear 93.

Figure 8:
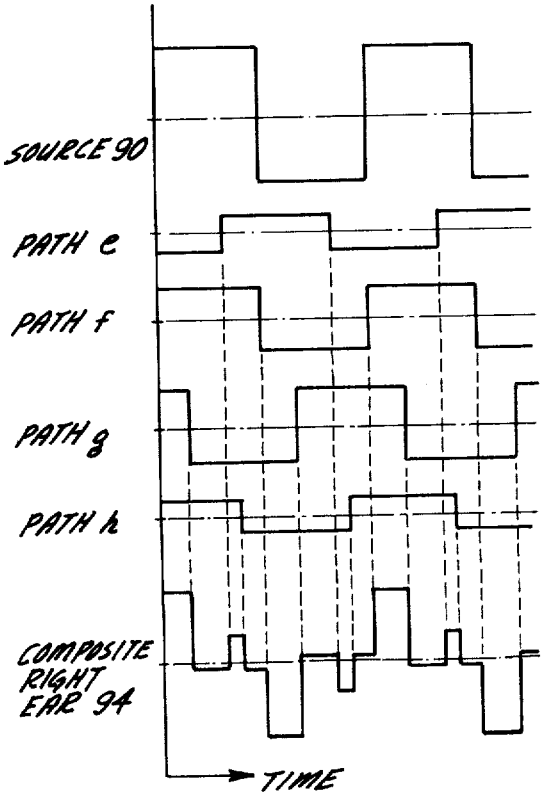
FIG. 8 illustrates the individual and composite waveforms of the primary propagation paths of sound that the listener in FIG. 5 receives in his right ear from the point source.

The square wave signals for each of the paths e, f, g and h according to their amplitude and relative timing upon striking the right ear are similarly illustrated in FIG. 8. These sound signals are likewise summed up to obtain the composite signal for the right ear 94, as shown.

Figure 7:
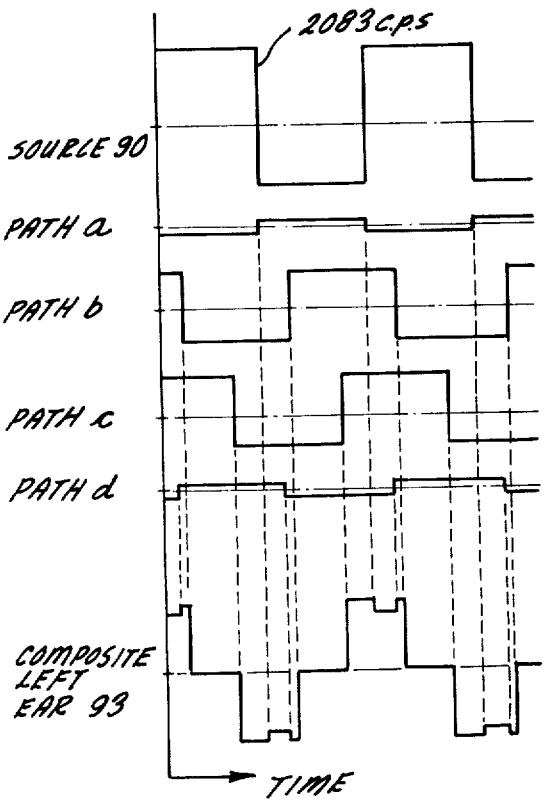
FIG. 7 illustrates the individual and composite waveforms of the primary propagation paths of sound that the listener in FIG. 5 receives in his left ear from the point source.

It should now be understood that the square wave signals illustrated in FIGS. 7 and 8 for each of the paths, as well as the composite signal at each ear, are literally what one would see if these signals were picked up by microphones located at the ears and amplified for display on an oscilloscope.

It should now be evident that the compositions of the waveforms hitting the left and right ears 93 and 94 of the listener 92 in FIG. 5 are considerably different. Furthermore, no matter where the listener stands in the room, or at what orientation the listener's head is in, he will receive a unique set of composition waveforms at his left and right ears.

It should now be clearly understood that the composite waveforms shown in FIGS. 7 and 8 are greatly simplified in that in a real live orchestral situation the sound source would not be a single point source but rather a large and complex one made up of a plurality of individual sound sources which would all provide propagation paths therefrom, selected ones only of which would strike the listener's ears 93 and 94, depending on his orientation, to thereby form the single composite waveform for each ear. Further, it should be understood that the example of the 2083 Hz, square wave source 90 is merely illustrative of the nature of the various sound paths and the composites thereof which are received by the left and right ears 93 and 94. An actual sound source would have sound waves which would represent the entire audio frequency spectrum, including the bass frequencies. Thus, it is the low frequency portion of the composite signals at the ears that are principally responsible for the preception of "depth", and an apparent large source of sound. The higher frequencies are generally more conducive to more precisely providing perception of the direction and distance.

It should be further understood that it is this unique composition of the signals at each ear which the sensing mechanism of the person responds to and utilizes or learns to utilize from experience over the years to localize sounds such that he can detect the direction, distance, size and shape of the sound source.

Reference will next be made to FIGS. 9, 10, 11 and 12 to illustrate the composition of the sound signals from the same square wave source 90 that arrives at microphones 99 and 100 placed in the same concert hall 91 shown in FIG. 5 to make a pair of recordings for conventional stereo. Thus, in place of the listener 92 in the concert hall 91, a pair of microphones 99 and 100 are placed 6 to 8 feet apart literally like in a recording studio.

As before, the primary propagation paths of the sound from the source 90 to the left and right microphones 90 and 100 are illustrated in FIG. 9. Thus, the left microphone 99 receives sound along a direct path m, a first reflected path n that reflects off the left wall 96, a second reflected path o which reflects first off the right wall 97 and then the left wall 96, and a third reflected path p (not shown) that reflects off the ceiling of the concert hall 91.

Likewise, the right microphone 100 received sound along a direct path q, a first reflected path r that reflects off the right wall 97, a second reflected path s which which reflects first off the left wall 96 and then the right wall 97, and a third reflected path t (not shown) that reflects off the ceiling.

Next to be noted is that the basis of determining the amplitude of the sound signals along each of the paths that hit the pair of spaced microphones 99 and 100 are going to be different then they were for the ears 93 and 94 of listener 92. Thus, in the microphone situation, although the distance attenuation of the amplitude of the square wave sound signal is the same, the angle attenuation of the amplitude of the square wave signal is different because instead of having ears on the side of the listener's head, the microphones 99 and 100 have flat diaphragms facing the front of the concert hall. As illustrated in FIG. 10, for such position of the microphone 99, for example, having a diaphragm 98, the angle loss is 100% for sound signals approaching from each of the sides thereof and 0% for sound signals approaching from directly in front thereof. It is thus seen that the attenuation loss of the signal due to its angular approach as sensed by the microphone 99 is essentially a sinusoidal function whether reflected off the sidewalls or the ceiling of the room.

The waveforms of the sound signals along each of the primary propagation paths m–t taking their timing into account are illustrated for the left microphone in FIG. 11 and for the right microphone in FIG. 12. The composites of these sound signals hitting each of the microphones are shown to be considerably different from each other. Also to be noted is that the compositions of the sound signals that reach the two microphones are considerably different from the compositions of the sound signals that reach the ears of the listener. One thing that is very apparent in FIG. 5 is that the direct signals to the ears 93 and 94 are greatly attenuated due to their location on the sides of the head. On the other hand, as illustrated in FIG. 9, the direct signals to the microphones 99 and 100 are hardly attenuated at all. Furthermore, what is happening in the microphone situation is that the reflected signals are attenuated a great deal more than the direct signals whereas in the ear situation just the reverse is true. So from this it can be expected that the structures of the respective compositions are going to be quite different.

The composite signals illustrated in FIGS. 11 and 12 are the equivalent of stereo signals, so it is these signals which are provided on a phonograph record whereas the composite signals in FIGS. 7 and 8 are the equivalent of binaural signals, that is, the signals provided in a concert hall by a live performance.

It should now be clear that the compositions of the sound of a live performance as recorded by the pair of microphones for a stereo system are not correct for binaural listening. Therefore, the objective of the present invention is to take the compositions as obtained by playing back stereo recordings and propagate them toward the listener in the same manner as they were propagated toward the recording microphones, thus allowing the ears of a listener to, in effect, "recompose" the signals into binaural compositions. Then one's perception mechanism, whatever it does with these kind of compositions, is going to perceive that there is an orchestra out there.

Having described and illustrated the compositions of the sound signals which strike the ears of a listener in a concert hall, and having described and illustrated that the sound signals recorded and played back by conventional stereo loudspeakers do not have the proper compositions to provide binaural signals, next to the described are the speaker cabinets of the present invention.

Figures 14, 15, 16, 17, 18:
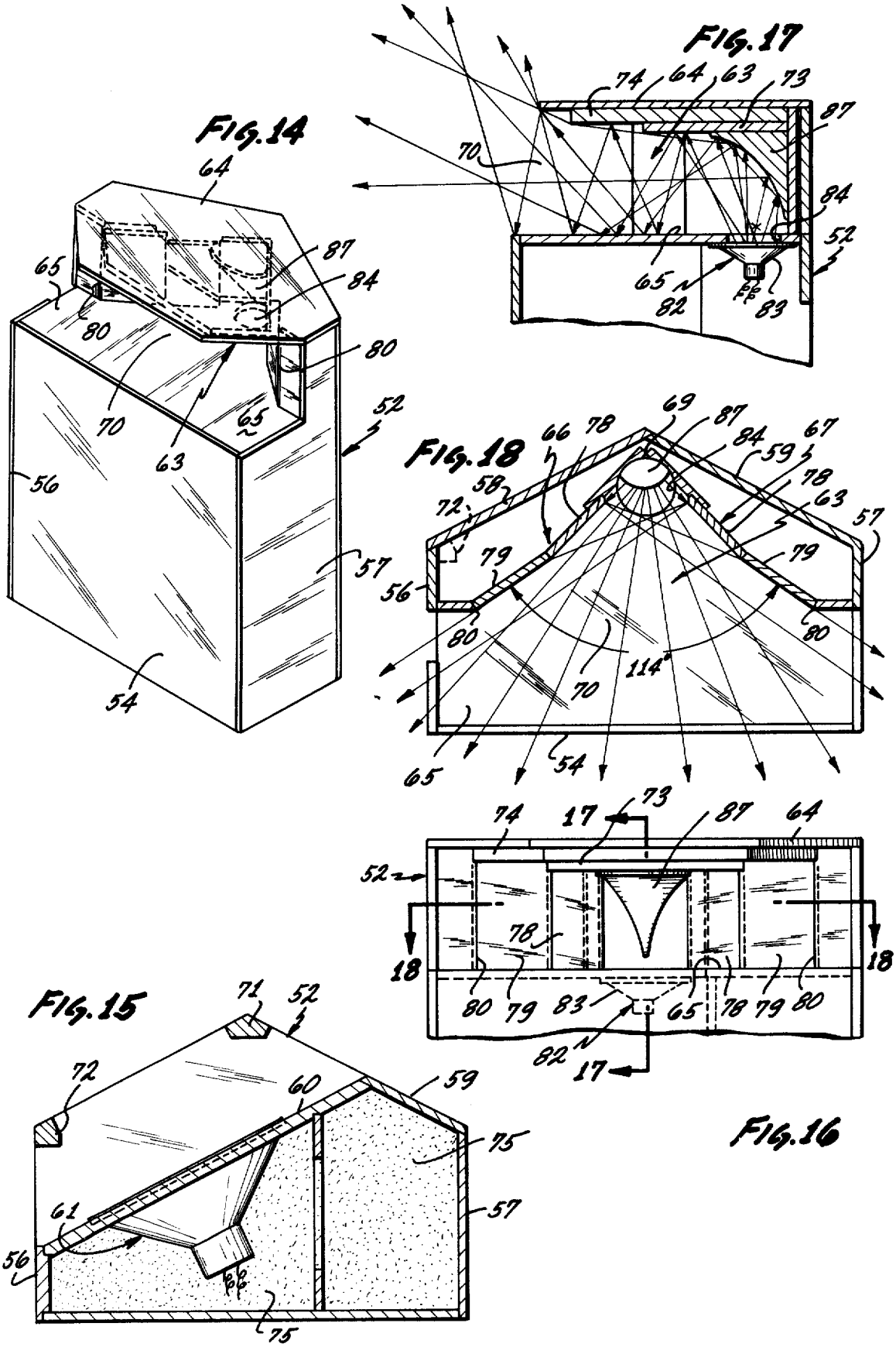
FIG. 14 is a front perspective view of the left speaker cabinet of the present invention.
FIG. 15 is a plan sectional view of the speaker cabinet as taken along line 15—15 of FIG. 13.
FIG. 16 is a front view of the upper chamber portion of the speaker cabinet of the present invention.
FIG. 17 is a vertical sectional view of the speaker cabinet as taken along line 17—17 of FIG. 16 and illustrates the high frequency sounds being reflected off the segment of the Y-axis parabaloid into the chamber and dispersed through the outlet port thereof.
FIG. 18 is a plan sectional view of the speaker cabinet as taken along line 18—18 of FIG. 16 and illustrates the high frequency sounds being reflected off the segment of the Y-axis parabaloid into the chamber and dispersed through the outlet port thereof.

Reference will next be made to FIGS. 13 and 14 which respectively show rear and front perspective views of the left hand speaker cabinet 52 of the present invention. Speaker cabinet 52 has a front wall 54, parallel sidewalls 56 and 57 extending normal thereto, and two angularly disposed half rear walls 58 and 59. As best shown in FIGS. 13 and 15, the lower portion of the angular rear wall 58 and the adjacent side portions of the sidewall 56 and the angular rear wall 59 are cut away leaving only the corner posts 71 and 72. An angular panel 60 is then secured to the recessed back edges of the walls 56 and 59 so as to be disposed inwardly from, below and parallel to the angular rear wall 58. The angular panel 60 has a lower frequency range loudspeaker 61 of the acoustic suspension type mounted thereon (FIG. 15).

As shown in FIGS. 14, 16 and 18, located on the top of the cabinet 52 is a V shaped mixing chamber 63 formed of a top wall 64, a bottom wall 65, and sidewalls 66 and 67. The mixing chamber 63 has its V-end 69 located toward the rear and its outlet port 70 facing the front. The top of the chamber 63 is provided with stepped members 73 and 74 (FIG. 17). As best illustrated in FIG. 18, the V shaped sidewalls 66 and 67 have opposing inner straight sections 78 angularly spaced at approximately 90 degrees and opposing outer straight sections 79 angularly spaced at approximately 114 degrees. The front of the top wall 64 is shortened relative to the bottom wall 65. The front side edges 80 of the mixing chamber which define the sides of the outlet port 70 are cut part way inwardly from the front end of the top wall 64.

As best illustrated in FIGS. 17 and 18, mounted below the bottom wall 65 of the chamber 63 near the V-end 69 thereof is a high frequency range loudspeaker 82 having its cone 83 facing vertically upwardly and fitted about a circular opening 84 in the bottom wall 65. Disposed within the V-end 69 of the mixing chamber 63 is a quadrant of a Y axis parabaloid of revolution 87, hereinafter referred to as a parabolic reflector. The parabolic reflector 87 is preferably shaped to form circular sections in planes parallel to the horizontal plane and parabolic sections in vertical planes radially extending from the center of revolution. The enclosure provided in cabinet 52 for the low frequency range loudspeaker 61 is preferably filled with a loose dacron material 75 so that it will not have any sound characteristics of its own.

The right hand speaker cabinet 53 is constructed the same as the left hand speaker cabinet 52 except that is a mirror image thereof.

Reference will next be made to FIG. 19, which shows a crossover and equalizing electrical circuit 101 that is connected to the low frequency speaker 61 and the high frequency speaker 82 in each of the loudspeaker cabinets 52 and 53. One of the channels of signals reproduced from a conventional stereo record is fed into the input 102 from an amplifier (not shown) and passed into inductor L1 which represents a very low impedence to low frequencies. The capacitors C1 and C2, on the other hand, represent a very high impedence to low frequencies. Consequently the low frequencies readily pass to the voice coil 103 of the low frequency loudspeaker 61 while the high frequencies are prevented from passing to the voice coil 106 of the high frequency loudspeaker 82.

As the frequencies of the sound get higher, the reactance of the inductor L1 gets higher and the reactance of the capacitor C1 gets lower and so less and less of the signal is applied across the voice coil 103 of the low frequency loudspeaker 61 and more and more of the signal is applied across voice coil 106 of the high frequency loudspeaker 82.

As the frequencies of the input signals get higher they are applied across the voice coil 106 of the high frequency loudspeaker 82 by way of a dividing network 104 comprised of a capacitor C2 in series with a resistor R1 which effectively serves to provide a constant impedance and volume equalization at the input to the high frequency voice coil 106 at all times. In other words, at the crossover point, approximately 350 Hz., the volume of the low frequency loudspeaker 61 and the high frequency loudspeaker 82 are very nearly equal. However, this situation will only persist for a few cycles because as the frequency increases the volume of the low frequency speaker 61 drops off rapidly due to the increasing impedance of L1 and the decreasing impedance of C3 and is taken over entirely by the high frequency loudspeaker 82.

This takes place first at mid-range frequencies through the dividing network C2 and R1 which serves to maintain a constant volume level as frequencies rise through the crossover point. As frequencies rise above mid-range into the high frequency range, the small capacitor C1 takes over due to its decreasing impedance, effectively by-passing the dividing network 104 and increasing the signal sent to the voice coil 106. This is done to compensate for the normal decrease in efficiency of cone type loudspeakers as frequencies increase, thus providing an essentially flat frequency response from the crossover point to the upper limits of the listener's hearing ability.

Having described the speaker cabinets of the present invention, next to be discussed is the manner in which the speaker apparatus of the present invention reproduces the sound signals obtained from stereo recordings made by microphones 32 and 33 in the live concert hall.

Figure 20:
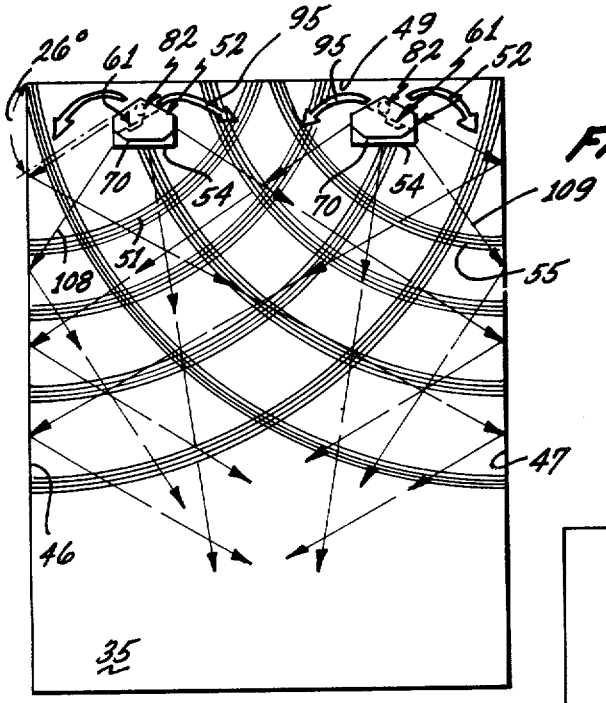
FIG. 20 is a diagrammatic plan view of a listening room illustrating the manner in which sound waves reproduced from a stereo recording are dispersed and propagated therein by use of the left and right speaker cabinets of the present invention.
Figure 21:
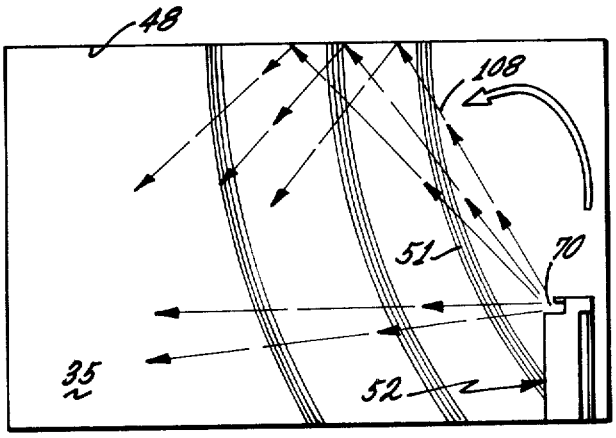
FIG. 21 is a diagrammatic vertical side view of the listening room of FIG. 20 illustrating the manner in which the sound waves reproduced from the stereo recording are dispersed and propagated therein by use of the left and right speaker cabinets of the present invention.

Reference will next be made to FIGS. 20 and 21 which are plan and vertical views of the same living room 35 shown in FIG. 3 with the stereo speaker cabinets 36 and 37 removed and replaced by the left and right speaker cabinets 52 and 53 of the present invention.

Each of the left and right speaker cabinets 52 and 53 is positioned with its front wall 54 parallel to the front wall 49 of the living room 35 such that the outlet port 70 of its V shaped mixing chamber 63 opens facing the interior of the room 35. When each of the cabinets 52 and 53 is so positioned, its low frequency range loudspeaker 61 is disposed slightly toward a respective front corner of the room 35 at an angle equal to approximately 26 degrees with the front wall 49 (FIG. 20).

By use of the crossover and equalizing circuit 101. the reproduced low frequency sounds, up to about 350 Hz., of the two stereo channel recordings obtained in the concert hall 10 by use of pickup microphones 32 and 33 are respectively fed to the low frequency loudspeakers 61 in the left and right cabinets 52 and 53. The loudspeakers 61 radiate these sounds such that they are dispersed as indicated by arrows 95 (FIG. 20) off the front wall 49, corners and ceiling of the living room 35 such that they advance with huge wave fronts 51 and 55 converging toward the interior of the room.

Additionally, an important feature of the low frequency system of the present invention is in not having low frequency speakers aimed toward the center of the front wall 49. This is because the low frequency power is additive when both speakers 61 are in phase and the apparent source in a recorded orchestra is midway between the speaker cabinets 52 and 53. In other words, the arrangement of the low frequency speakers prevent over-emphasis of the low frequency sounds from the center of the orchestra. Thus the present design is intended to produce a uniform intensity of low frequency sound, whether the apparent source is from center, left or right. Variation in apparent intensity is then only a function of the recording, as it should be.

As noted in FIGS. 20 and 21, the low frequency sound waves 51 and 55 tend to be propagated from the left and right speaker cabinets 52 and 53 such as to have a pattern similar to the radiation of the low frequency sound waves in the actual concert hall 10 as depicited in FIGS. 1 and 2.

The reproduced high frequency sounds, above about 350 Hz., of the two stereo channel recordings are respectively fed by use of the crossover and equalizing circuit 101 to the high frequency loudspeakers 82 mounted on each of the left and right cabinets 52 and 53. The loudspeakers 82 radiate sound waves which advance upwardly and reflect off of the surfaces of the parabolic reflectors 87. As illustrated in FIGS. 17 and 18, these sound waves upon hitting the surfaces of the parabolic reflectors 87 are divergingly reflected and thus dispersed into the mixing chambers 63 where they reflect off the wall thereof and through the outlet ports 70. Some of the sound waves which pass through the focal point of the parabolic reflectors 87 are reflected from the surface thereof along substantially horizontal planes in mixing chambers 63 and through the outlet ports 70 into the interior of the room 35. Others of the sound waves emanating from points within or outside the focal rings reflect off surfaces of the parabolic reflectors 87 and bounce between the angular sidewalls 66 and 67 and/or the stepped top and the bottom walls of the mixing chambers prior to passing through outlet ports 70 into the interior of the room 35.

As previously mentioned, the top walls 64 of the mixing chambers 63 are shortened to permit the upwardly dispersed sound waves emitted from the outlet ports 70 to assume an angle of approximately 80 degrees above the horizontal while the lower walls 65 are extended to limit the downwardly dispersed sound waves to an angle of approximately 8 degrees below the horizontal. It should now be also clear that the outlet ports 70 and the sidewalls 66 and 67 of the chambers 63 control the emission of the sound waves over a range having an included horizontal angle of approximately 114 degrees.

As illustrated in FIGS. 20 and 21, the high frequency sound waves 108 and 109 emitted from the outlet ports 70 of the respective chambers 63 hit the respective sidewalls 46 and 47 and the ceiling 48 of the room 35 and reflect therefrom in a converging manner. In other words, the sounds are first divergingly dispersed from the cabinets 52 and 53 and then convergingly reflected from an infinite number of points off the walls and ceiling of the room 35 onto the listening area thereof. Thus, the propagation paths of the high frequency sound wave signals in both the horizontal and vertical views of the listening room 35, as illustrated in FIGS. 20 and 21, are quite similar to the propagation paths of the high frequency sound wave signals toward the microphones 32 and 33 in the similar views of the actual concert hall 10 as illustrated in FIGS. 1 and 2.

It should be especially noted that by use of the speaker cabinets 52 and 53 of the present invention there is no direct radiation of the sound waves from the high and low frequency range loudspeakers 82 and 61 to the listening area. This is because all of the sound radiated by these loudspeakers are initially reflected and dispersed before progressing toward the listener. The advantage of this is that it clearly negates any possibility that primary propagation paths will come directly from the loudspeakers themselves and thus distort the recreation of the primary propagation paths as they existed in the concert hall. This is because the primary propagation paths created from direct radiation, as stated before, indicate to the listener the nature of the immediate source of sound, while the reflection of sound waves may be controlled so that they do not indicate the nature of the immediate sound source. It should be also noted that by use of the speaker cabinets 52 and 53 there is no duplication of primary propagation paths of the same frequency range from both a speaker facing the front and a speaker facing the rear of the room. A further consideration in recreating the primary propagation paths is that it is necessary to control the nature of the first reflective surface encountered by the high frequency sound waves after leaving the high frequency speaker diaphragm; otherwise the desired radiation pattern to setup the primary propagation path in the listening room would be seriously affected by the high frequency absorption characteristics of the first reflective surface. It is for this reason, among others, that the parabolic reflectors 87 are used. It should now be apparent that the present invention provides for reflecting both high and low frequencies in a controlled manner so as to create a desired sound projection pattern such that the nature of the immediate sound sources, the loudspeakers, is not apparent to the listener.

It should now be clearly understood that the primary propagation paths of sound are defined as the first paths by which sound from a particular source reach the ears of a listener and are the ones from which the apparent size and direction or localization of the source of sound are determined. These first paths tend to preempt the localization mechanization in the ears such that the secondary, tertiary, and other reflections from the walls and the furniture in the room, merely serve to qualify the sound heard in the living room in accordance with its environment.

Thus, with the recreated primary propagation paths of the reproduced sounds present in the living room 35, the ears respond to the signals they contain such as to single out all the different instruments and so forth such that the listener has the feeling he is listening to a live performance. Thus, the reproduced sounds appear to a listener to be coming from instruments virtually located beyond the confines of the walls of the listening room 35, and give to the listener an illusion of sound that has the depth, width and height of the music in the concert hall.

The importance of this physical handling of the sound waves by the system and apparatus of the present invention is best appreciated when it is realized that when a stereophonic recording is made the only thing that can be recorded is the composite signal of each channel, determined principally by the primary propagation paths toward the mircophones at the scene of the recording, with minor modifications due to secondary, tertiary, and other propagation paths. The directions of the travel of the sounds from the particular instruments toward the microphones 32 and 33, per se, cannot be recorded. As previously discussed, however, the ears of the listener are sensitive not only to the relative phases, amplitudes and frequencies of the stereo signals being played back from a recording but also the compositions of the sound signals resulting from their primary propagation paths, which compositions inherently include these relative phases, amplitudes and frequencies. If the paths of sound provided in the listening room are not the proper ones for the source from which the sounds originate then the ears will develop composite signals that are different from those that they would have developed from the paths at the scene of the recording, were the listener there; and further the composite signals would not be binaural in their nature. In other words, unless the compositions of the signals at the ears resulting from these paths are binaural in nature, the listener will not get a true aural perception of the direction, distance, size and shape of the original source.

From the above, it should now be clear that whereas in the prior art, phase and amplitude have been considered the two most important aspects of sound localization, there is a third equally important factor to consider, namely the relative compositions of the sound at each of the ears which inherently contain the phase and amplitude differences.

It is believed that the role that the compositions of the sound at the ears play in determining sound localization can be realized by noting that what happens physiologically to a person, from the time one is old enough to hear, is that one is constantly bombarded with sound. Thus, one is gradually trained to the point where when one walks around the room the composition of the sound reaching one's ears, from whatever sound source is present, changes, and one's ears and perception mechanism sense this composition of the sound as well as the phase and the amplitude thereof and from this total information determine the localization of the sound. It is of interest to note that because the composition of the binaural sound is unique for each ear, people who are deaf in one ear are able to quite accurately detect the direction of a sound source.

It should now be understood that from a system point of view, in prior art stereo systems the missing thing, the duplicating of the propagation paths of the sounds of the instruments, has been heretofore a thing of chance. Thus, in conventional stereo, there may be some reflective surfaces that inadvertently reflect the sound waves so as to provide a little bit of the proper direction which enhances the stereo for the listener, somewhat. However, the speaker apparatus of the present invention comprising cabinets 52 and 53 when set up in a listening room, such as room 35, deliberately and in a controlled manner provide for dispersing and converging the sounds as to physically set up the primary propagation paths corresponding to the recorded information and thereby provide for the recomposition of the stereo sound to binaural sound at the ears of the listener.

It should be particularly noted that inasmuch as only the horizontal phase angle of the two channels of stereo sound can be recorded, a listener cannot derive any vertical sense of direction of the sound from such stereo information. It is only by recreating the primary propagation path from a source with a vertical component that the ears can sense the vertical placement, i.e., the elevation of a sound source. It is for this reason that the top walls 64 of the V shaped chambers 63 of the present speaker cabinets 52 and 53 are shortened to permit the signals to be dispersed upwardly to reflect off the ceiling 38 and down toward the listener in the room 35.

It should now be clearly understood that the purpose of the loudspeaker system and apparatus of the present invention is to reproduce stereo sound recordings having compositions similar to those illustrated in FIGS. 11 and 12 and recompose the stereo signals as they travel through the air such that they duplicate the field of sound at the concert hall and make it possible for a listener standing anywhere in the listening room to again hear the compositions of the sounds as illustrated in FIGS. 7 and 8.

The understanding of the present speaker apparatus can be further enhanced by examining the manner in which sound is handled in a binaural recording system. As previously mentioned a binaural recording is obtained from a live orchestra in a concert hall 10 by providing a dummy head 81 with microphones 85 and 86 where the ears are located, as indicated in FIGS. 1 and 2. The composite signals illustrated in FIGS. 7 and 8 are the equivalent of the binaural signals that would be recorded with microphones in the dummy head. When such a binaural recording is played back with a set of headphones the listener perceives a physical vector or localization for that sound, even though it does not physically exist, just as if he were listening to a live performance. Now the reason for this is because the only information that the listener needs in this situation for determining the direction of a source is the recorded composite signals which inherently contain the phase and amplitude information of the two binaural channels of sound.

In other words, in the case of a binaural recording there is no need for physical vectors corresponding to the propagation path characteristics of the sound field of the live performance to be physically created at the scene of the listener since the sound does not travel through the air after it has been once played back from the recording. Consequently, the physical recreation of the propagation paths of reproduced sounds is important only when the reproduced sound is played back in the air.

Of course, when a binaural recording is being used, the listener must have headphones on whereas the sound field from a stereo recording created by speaker cabinets 52 and 53 of the present invention eliminate the need for such headphones while providing a degree of realism which is as good if not better than that provided by binaural recordings.

To further appreciate the importance the compositions of the reproduced sounds have in localizing sound, it should be noted that when a pair of stereo recordings are played back on a pair of headphones the listener does not sense the orchestra as being in front of him but rather as scattered on either side of him. Thus, even though the phase and amplitude differences are even more pronounced by the recordings picked up by the spaced stereo microphones than they were in the case of the recordings picked up by microphones in a dummy head, one still cannot perceive the true three dimensional aural image of an orchestra. Therefore, it appears clear that there is something besides phase and amplitude differences that are necessary to perceive depth, size, shape, distance, and direction of a sound source. It thus becomes apparent that since the composition of a binaural signal is so different from the composition of a stereo signal that it is this composition which strikes the ear that is the additional factor that creates this illusion of depth and reality.

It should now be clearly understood that in order to playback stereo recordings so that the listener gets an illusion of three dimensional sound it is necessary to playback and propagate sound toward the listener in such a manner that the primary propagation paths toward the listener created by a system of reflections will be essentially the same as those propagating toward the microphones at the time of the recording, so that by the time the sound source reaches one's ears, the compositions produced therein are binaural in their nature.

What it amounts to is that a listener desires to hear two reproduced channels of stereo signals anywhere in a listening room as though they were binaural signals recorded in the dummy head but without the need for headphones. Thus, if a recording of these channels of stereo sound had not been made, i.e., if instead of recording the stereo signals at spaced microphone locations, the live sound had been permitted instead to go to a listener at that instant, the listener would clearly have received the binaural signals in each ear. By recording the signals to provide conventional stereo recordings, the physical propagation paths have gotten lost except that the composition of the signals recorded at the microphones is a function of the propagation paths up to the position of the microphones. It should now be clearly understood that the speaker apparatus and system of the present invention effectively provide for physically converting the recorded stereo sound signals into binaural sound signals at the ears of the listener and therefore can be defined as the completion of the stereophonic system.

The understanding of the overall concept of how the present speaker apparatus and system operate to change a stereo signal to a binaural signal as far as composition at the ears are concerned can be simplified somewhat by realizing that the effect produced can be likened to placing the living room 35 in the concert hall 10 with the front wall thereof removed. If this were actually done, then the live music that was proceeding outwardly from the orchestra would propagate into the living room and converge upon the listener in a perfectly realistic manner. Thus, if the living room literally sat in the concert hall, a listener sitting in the living room would receive composite signals at his ears due to the primary propagation paths of the live sound that would be characteristic of a listener sitting in a living room which is placed in a concert hall that has an orchestra in the front end thereof. Clearly, a listener in such a situation would hear the live orchestra with all of its realism.

Now instead of setting the living room in the concert hall, the loudspeaker cabinets 52 and 53 of the present invention are placed in the front of the living room 35 to disperse the reproduced stereo sounds and cause them to be reflected off the sidewalls and ceiling of the room so that they proceed toward the listener as though the physical situation just described were in fact the case. In order to accomplish this, the first eight feet or so of the living room is used as a part of the mechanization that aids in getting the propagation paths started. It should now be clear that one's ears do not care whether or not they are receiving primary propagation paths of sound in a living room that is placed in a concert hall with the front wall removed or whether they are receiving primary propagation paths of sound physically created by the loudspeaker cabinets 52 and 53. All the listener's ears are concerned with are whether they are getting the primary propagation paths coming toward them which they can recompose to provide binaural composite signals at their ear drums.

What it amounts to is the primary propagation paths toward the listener's ears that existed between the performers and the stereo microphones in the original setup are recreated by the speaker apparatus and system of the present invention. Having done that then all a person has to do is sit anywhere in the room and listen and his ears will automatically compose signals at their ear drums like those that would have been recorded in the microphones in a dummy head for binaural recording in a concert hall. So the listener senses a three dimensional listening experience.

In summary, the loudspeaker system and apparatus of the present invention takes cognizance of the fact that the primary propagation paths of the binaural sounds from a complex live sound source in a concert hall 10 (FIG. 1) are effectively stopped at the microphones 32 and 33 upon the recording of the two channels of stereo. Since the composite waveform representing the sound was collected at a point, upon being played back and sent out again, it has all the information in it to once again get scattered across the room and be collected at another point as a binaural signal. It is by means of the speaker cabinets 52 and 53 of the present invention, together with the front wall and the first eight feet or so of the sidewalls and the ceiling of the listening room 35, that the primary propagation paths of the sound are physically recreated causing them to get started on their way in the same manner in which they were headed toward the microphones 32 and 33 when originally recorded. Thus, having physically set up the primary propagation paths, they continue to reflect in the room 35 as they originally did in the concert hall and so what the listener gets anywhere in the listening area of the room are reflected signals that recompose as they advance so as to be binaural by the time they reach his ears. It should now be clear that by use of the present speaker apparatus the listener is perceiving sound in a listening room derived from propagation paths which are a continuation of those from which the recording was made. Thus, the listener perceives the orchestra and its various instrument placements on the stage or in the studio the way he would with a binaural recording and headphones except that he is freed of the headphones and can hear the binaural signals throughout the listening area of the room.

While the foregoing disclosure has been primarily concerned with a particular embodiment, it is to be understood that the invention is susceptible of many modifications in construction and arrangement. The present invention, therefore, is not to be considered as limited to the specific disclosure provided herein, but is to be considered as including all modifications and variations coming within the scope of the invention as defined in the appended claims.

What is claimed is:

1. A system for generating binaural sound in a rectangular room from a stereo recording made of a live performance, said room having a front wall, sidewalls and a ceiling, said system comprising:

a low frequency range loudspeaker means;

a high frequency range loudspeaker means;

said low frequency range loudspeaker means disposed to radiate energy therefrom rearwardly and sidewardly so as to reflect off the front wall, sidewalls and ceiling of the room whereby upon advancing into the listening room it converges upon the listening area thereof; and dispersing means including a portion of a parabaloid of revolution having a reflective surface;

said high frequency range loudspeaker means disposed generally at the focus of the parabaloid of revolution to radiate energy therefrom upwardly to reflect off the reflective surface thereof such that said high frequency range energy is divergingly dispersed forwardly by said dispersing means over a horizontal and vertical angular range whereby upon advancing into the listening room it reflects off the sidewalls and ceiling of the room and converges upon the listening area thereof.

2. A system for generating binaural sound in a listening room from the two channels of stereo recording made of a live performance, said listening room having a front wall, sidewalls and a ceiling, said system comprising:

a pair of enclosed speaker cabinets respectively disposed on the sides of the front wall of said listening room;

each said speaker cabinet including:

a low frequency range loudspeaker mounted thereon to substantially face the front of the listening room so that low frequency sound reproduced from a channel of said stereo recording is reflected off the front wall, sidewalls and ceiling of the listening room so as to converge onto the listening area thereof;

a dispersing chamber on the top of said speaker cabinet having an outlet port facing the listening area of the room;

a reflector in the rear of said dispersing chamber having a convex surface; and a high frequency range loudspeaker mounted below said reflector so that high frequency sound reproduced from a channel of said recording is laterally and angularly reflected off the convex surface thereof into the dispersing chamber and out the outlet port thereof such that a portion of said high frequency sound strikes the sidewalls and ceiling of the room so as to converge onto the listening area thereof;

whereby primary propagation paths of sound are physically created throughout the listening area in the room in a manner similar to and in context with those present in a concert hall during a live performance.

3. A system for generating binaural sound in a listening room from the two channels of a stereo recording made of a live performance in a concert hall, said listening room having a front wall, sidewalls and a ceiling, said system comprising:

a pair of speaker cabinets for respectively reproducing said two channels of stereo recording;

each said cabinet including:

a low frequency range loudspeaker disposed to radiate energy from a channel of said stereo recording such that it is reflected off the front wall, sidewalls, and ceiling of the listening room so as to converge onto the listening area thereof;

a V-shaped mixing chamber having a top and bottom wall and disposed with an opening facing the listening area of the room;

a segment of a parabaloid located in the corner of said mixing chamber; and a high frequency range loudspeaker disposed to face upwardly to reflect energy off of said segment of a parabaloid into the mixing chamber from which it is divergingly dispersed forwardly onto the sidewalls and ceiling of the listening room so as to convergingly reflect onto the listening area thereof;

whereby said pair of speaker cabinets produce primary propagation paths of sound in the listening room having configurations similar to and in context with those present in a concert hall during the live performance.

4. A sound generating system in accordance with claim 3 wherein the top wall of said chamber is shorter than its bottom wall so as to divergingly disperse said high frequency sound angularly upwardly such that it convergingly reflects from the ceiling onto the listening area.

5. A sound generating system in accordance with claim 3 wherein said segment of a parabaloid is shaped to form circular sections in horizontal planes and parabolic sections in vertical planes radially extending from its center of revolution.

6. A sound generating systen in accordance with claim 3 wherein the V-shaped mixing chamber has sidewalls shaped to define an included angle of approximately 114 degrees.

7. A sound generating system in accordance with claim 3 wherein the low frequency range loudspeakers are disposed on said respective speaker cabinets at an angle of approximately 26 degrees on either side of the front wall of the listening room.

8. A system for generating binaural sound from a stereo recording in a rectangular listening room having a front wall, sidewalls and a ceiling, said system comprising:

a pair of speaker cabinets positioned along either side of the front wall of said listening room;

each said speaker cabinets including:

a dispersing means including a portion of a parabolic reflector;

an upwardly facing high frequency range speaker disposed below said portion of a parabolic reflector for radiating high frequency energy therefrom which is divergingly dispersed by said dispersing means over a horizontal and vertical arcuate range into the listening room such that a portion of said high frequency energy convergingly reflects from said sidewalls and ceiling onto the listening area thereof; and a low frequency range speaker facing the front wall at a small angle toward an adjacent corner thereof for radiating low frequency energy such that it convergingly reflects off the front wall, sidewalls and ceiling of the listening room onto the listening area thereof;

whereby primary propagation paths of sound are created in the listening area which upon striking each ear of a listener provide a unique composition no matter where the listener is located in the listening area from which the listener is able to sense the direction, distance, and size of the original sound with the realism of a live performance.

9. A system for generating binaural sound from two channels of stereo recordings in a rectangular listening room having a front wall, sidewalls and a ceiling, said system comprising:

a pair of speaker cabinets, each said speaker cabinets having a rearwardly facing low frequency range loudspeaker mounted on an angularly disposed panel on the rear thereof, a V shaped mixing chamber with a forwardly facing outlet port, a portion of a parabaloid in the corner of said V shaped chamber, and an upwardly facing high frequency range loudspeaker mounted below said portion of a parabaloid;

said speaker cabinets being positioned along the front wall of said listening room with their low frequency range loudspeakers facing rearwardly at a small angle toward the respective front side corners thereof and with the outlet ports of their V shaped chambers facing forwardly onto the listening area of the room;

whereby the low frequency range of the sound reproduced from the two channels of stereo recording radiate from the respective rearwardly facing low frequency range loudspeakers and reflect off either side of the front wall, sidewall and ceiling of the room so as to advance forwardly with wavefronts converging onto the listening area thereof; and whereby the high frequency range of the sound reproduced from the two channels of stereo recording radiate from the respective upwardly facing high frequency range loudspeakers so as to reflect off the respective portions of a parabaloid such as to divergingly disperse sound through the outlet ports of the mixing chambers onto the sidewalls and ceiling of the listening room from which the sound convergingly reflects onto the listening area thereof.

10. A system for generating binaural sound from two channels of stereo recording as defined in claim 9 including a crossover and equalizing electrical circuit for feeding high frequency sound signals to the high frequency range loudspeakers and for feeding low frequency sound signals to the low frequency range loudspeakers.

11. A system for generating binaural sound from two channels of stereo recording as defined in claim 10 wherein the crossover point for feeding said sound signals is approximately 350 Hz.

12. A system for generating sound reproduced from a pair of stereo channel recordings in a rectangular listening room having a front wall, sidewalls and a ceiling, said system comprising:

a pair of speaker cabinets each having a V shaped chamber with an outlet port facing the front thereof;

a segment of a parabaloid disposed in the corner of each of the chambers;

an upwardly facing high frequency loudspeaker disposed in each of said cabinets below said segment of a parabaloid;

a rearwardly facing low frequency loudspeaker disposed on the rear of each of said cabinets;

said cabinets positioned adjacent either side of the front wall of said listening room; and circuit means for feeding low frequency sound reproduced from said pair of stereo channel recordings to the respective low frequency loudspeakers and for feeding high frequency sound reproduced from said pair of stereo channel recordings to the respective high frequency loudspeakers;

whereby the low frequency loudspeakers provide for radiating low frequency sounds for convergingly reflecting off the front wall, sidewalls and ceiling of the room into the listening area thereof; and whereby the high frequency loudspeakers provide for radiating high frequency sounds such that they reflect off the segments of the parabaloids and are divergingly dispersed through the outlet ports of said chambers such that they convergingly reflect off the sidewalls and ceiling onto the listening area of the room, thereby providing a binarual effect throughout the listening area of the room.

13. A sound system for generating sound reproduced from a pair of stereo channel recordings in a rectangular room having a front wall, sidewalls and a ceiling, said system comprising:

a pair of speaker cabinets disposed in said room on either side of the front wall thereof;

each of said speaker cabinets including:

a V shaped mixing chamber with an outlet port facing the listening area of said room;

a portion of a parabaloid located in the corner of said mixing chamber;

a low frequency loudspeaker disposed to face the front wall at a slight angle toward the adjacent corner of the room;

a high frequency loudspeaker disposed to face the bottom of said portion of a parabaloid; and a crossover network for feeding stereo signals below approximately 350 Hz. as reproduced from said pair of stereo recordings to respective low frequency loudspeakers and for feeding stereo signals above approximately 350 Hz. as reproduced from said pair of stereo recordings to respective high frequency loudspeakers;

said low frequency loudspeakers providing sound which reflects off either side of the front wall, sidewalls and ceiling of the room such that it advances into the listening area thereof with a wavefront similar to the manner in which low frequency sound is advanced toward a listener in a concert hall; and said high frequency loudspeakers providing sound which reflects off said portion of a parabaloid and is divergingly dispersed through the outlet ports of said chambers forwardly and angularly onto the sidewalls and ceiling of the room from which the sound converges upon the listening area of the room similar to the manner in which high frequency sound is advanced toward a listener in the concert hall;

whereby a listener in the room receives binarual signals and therefore perceives an aural illusion of the original performance in a concert hall.

14. A method for converting a stereo recording into binaural signals in a listening room having a frontwall, sidewalls and a ceiling, said method including the steps of:

radiating the low frequency sounds of said stereo recording onto either side of the front wall, the sidewalls, and the ceiling such that all said low frequency sounds convergingly reflect forwardly onto the listening area of the room; and radiating the high frequency sounds of said stereo recording onto portions of parabolic reflectors which provide for divergingly dispersing all said high frequency sounds forwardly and angularly onto the ceiling and sidewalls of the room such that they convergingly reflect onto the listening area of the room;

whereby the convergingly reflected sounds provide primary propagation paths of sound throughout the listening area a particular set of which combine depending on the location of the listener to provide composite signals at his ears for discerning distance, direction, size and location of the sounds as in a live performance.

15. A system for generating binarual sound in a room from a stereo recording made of a live performance, said room having a front wall, sidewalls and a ceiling, said system comprising:

low frequency range loudspeaker means for reflecting all the reproduced low frequency range sound waves off the front wall, sidewalls and ceiling of the room so as to converge onto the listening area thereof;

high frequency range loudspeaker means;

dispersing means for reflecting and dispersing all the high frequency range sound waves reproduced by said high frequency range loudspeaker means forwardly into the listening area of the room over a lateral range of approximately 114 degrees and a vertical range of approximately 80 degrees such that portions of said high frequency sound waves reflect off the sidewalls and ceiling of the room so as to converge onto the listening area thereof;

whereby primary propagation paths of sound waves are physically created in the listening area of the room from the low and high frequency range of sound waves similar to the paths these ranges of sound waves have when recorded during the live performance.

* * * * *